US008597168B2

(12) United States Patent
Koesters et al.

(10) Patent No.: US 8,597,168 B2
(45) Date of Patent: Dec. 3, 2013

(54) METHOD OF MAKING BAG WITH HANDLE ON SIDE GUSSET

(75) Inventors: Jens Koesters, Wallenhorst (DE); Alfons Kruse, Dinklage (DE); Jochen Brauer, Lohne (DE)

(73) Assignee: Nordenia Deutschland Halle GmbH, Halle (DE)

( * ) Notice: Subject to any disclaimer, the term of this patent is extended or adjusted under 35 U.S.C. 154(b) by 153 days.

(21) Appl. No.: 13/023,230

(22) Filed: Feb. 8, 2011

(65) Prior Publication Data

US 2011/0206300 A1 Aug. 25, 2011

(30) Foreign Application Priority Data

Feb. 10, 2010 (EP) ..... 10001392

(51) Int. Cl.
*B31B 19/86* (2006.01)
*B65D 33/06* (2006.01)

(52) U.S. Cl.
USPC ..... 493/226; 493/221; 53/134.1

(58) Field of Classification Search
USPC ..... 53/134.1; 493/226, 221
See application file for complete search history.

(56) References Cited

U.S. PATENT DOCUMENTS

| | | | | | |
|---|---|---|---|---|---|
| 2,985,355 | A * | 5/1961 | Read | 383/6 |
| 3,208,492 | A * | 9/1965 | Braithwaite | 383/8 |
| 3,486,421 | A * | 12/1969 | Otto | 493/221 |
| 3,507,194 | A * | 4/1970 | Schwarzkopf | 493/196 |
| 3,753,824 | A * | 8/1973 | Bosse | 156/227 |
| 5,382,215 | A * | 1/1995 | Mattiebe | 493/221 |
| 5,421,805 | A * | 6/1995 | Baxter et al. | 493/226 |
| 6,059,709 | A * | 5/2000 | Achelpohl et al. | 493/226 |
| 6,574,940 | B2 * | 6/2003 | Dauder Guardiola | 53/134.1 |
| 6,899,663 | B2 * | 5/2005 | Tetenborg | 493/221 |
| 7,866,885 | B2 * | 1/2011 | Kujat et al. | 383/6 |
| 8,142,340 | B2 * | 3/2012 | Mantzivis | 493/88 |
| 8,322,923 | B2 * | 12/2012 | Gum | 383/26 |
| 2007/0274612 | A1 * | 11/2007 | Chaturvedi | 383/10 |
| 2008/0080794 | A1 | 4/2008 | Kruse | |
| 2009/0202181 | A1 * | 8/2009 | Alaux | 383/7 |
| 2011/0033133 | A1 * | 2/2011 | Kujat | 383/20 |

FOREIGN PATENT DOCUMENTS

| | | | |
|---|---|---|---|
| DE | 202007014358 | U1 | 11/2008 |
| EP | 1712482 | B | 10/2006 |
| EP | 1792722 | A | 11/2008 |
| EP | 1777167 | B | 3/2009 |
| EP | 2039620 | A | 3/2009 |
| EP | 2039620 | A1 | 3/2009 |

* cited by examiner

*Primary Examiner* — Hemant M Desai
(74) *Attorney, Agent, or Firm* — Andrew Wilford

(57) ABSTRACT

A side-gusset bag has face panels each having a pair of side edges. Two respective side gussets are each connected between a respective one of the side edges of one of the face panels and a respective one of the side edges of the other face panel. The face panels and side gussets together form a bag body formed along each of the side edges flanking one of the gussets with at least one slot. Two respective carry handles each have a middle section outside the body and a pair of ends extending through a respective one of the slots with the two carry handles at least generally aligned with each other. Welds secure each of the ends inside the body to the respective side gusset and close the slots around the ends.

8 Claims, 8 Drawing Sheets

Fig.2A
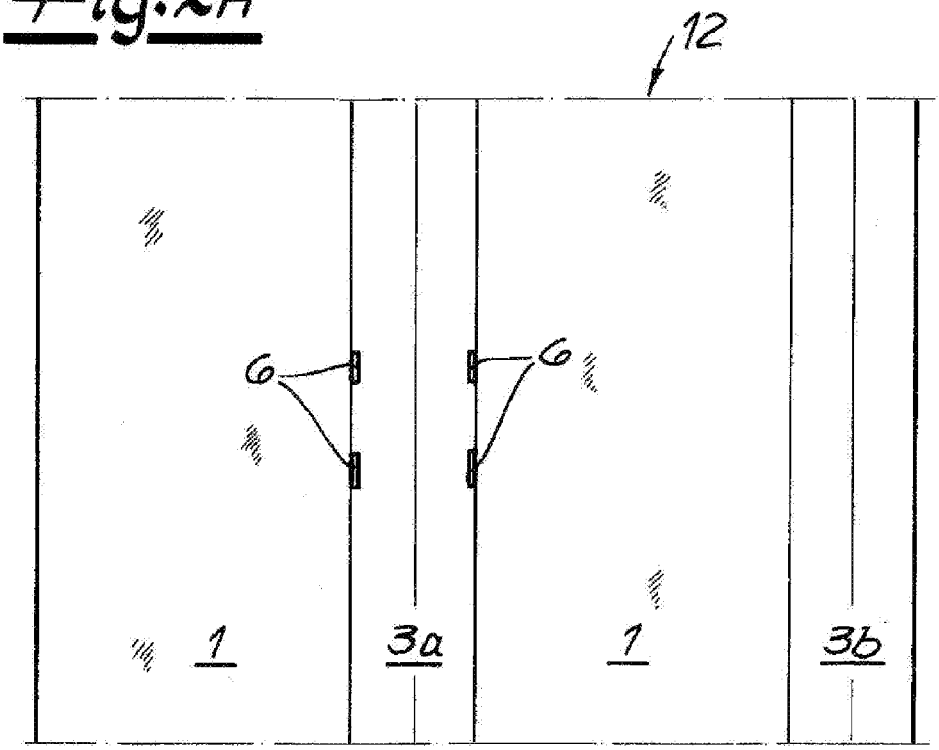
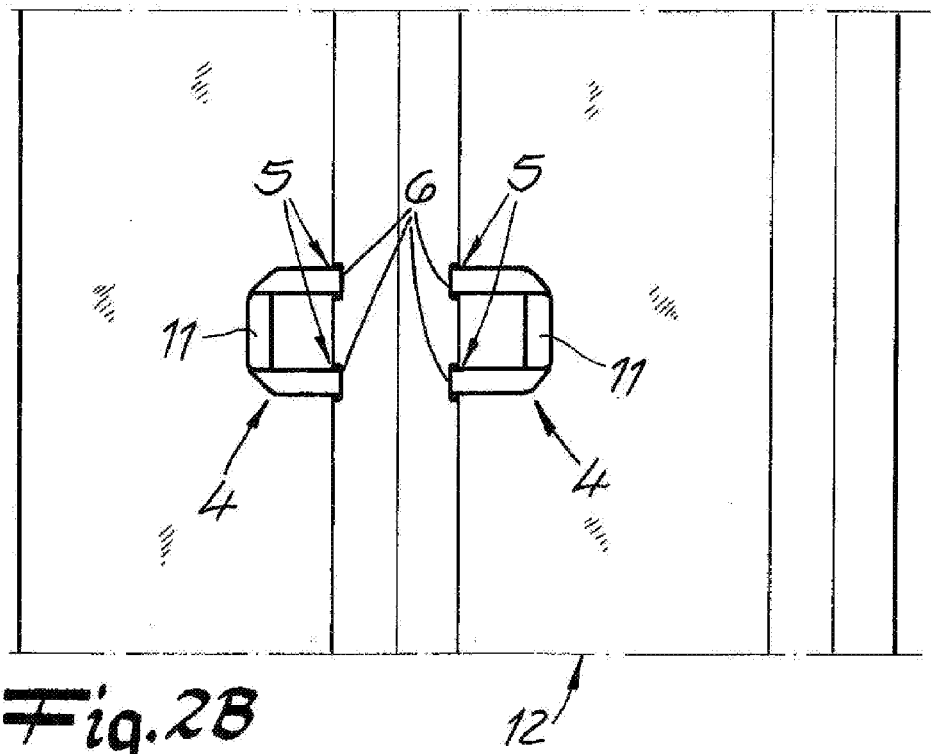
Fig.2B

Fig. 2D
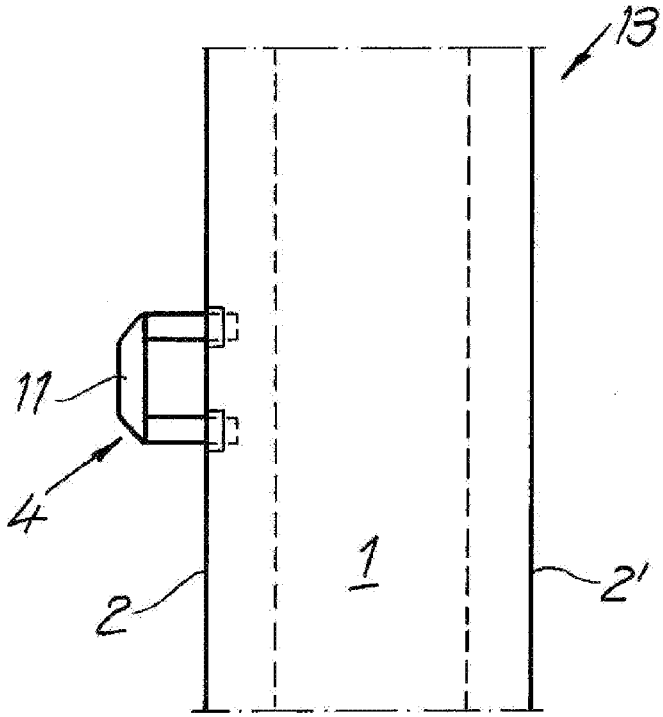
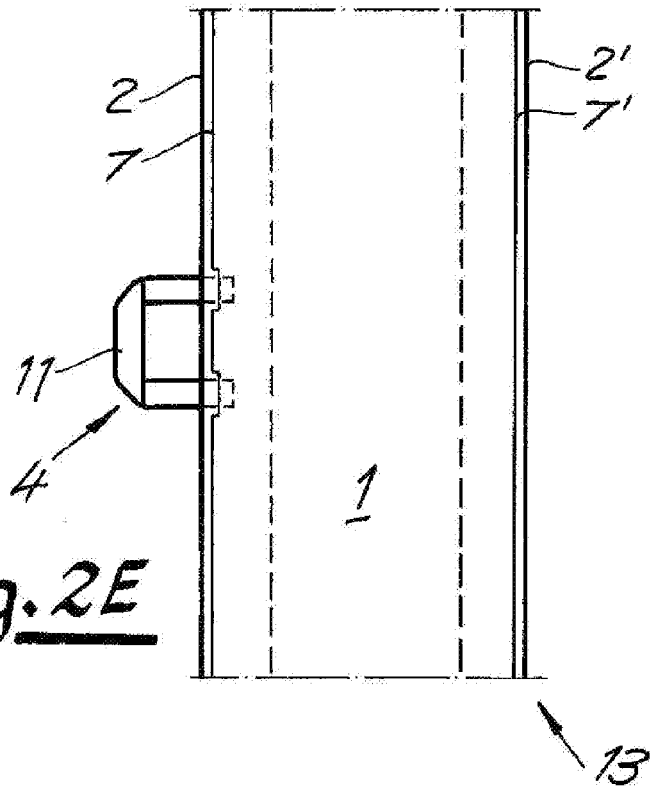
Fig. 2E

METHOD OF MAKING BAG WITH HANDLE ON SIDE GUSSET

FIELD OF THE INVENTION

The present invention relates to a bag. More particularly this invention concerns a side-gusset bag for bulk material and a method of making this bag.

BACKGROUND OF THE INVENTION

A typical bag for holding bulk material comprises two face panels, side gussets bridging and extending between side edges of the face panels, and a carry handle on one of the side gussets. Such a side-gusset bag is suitable in particular for packaging bulk goods like, for example, pet-food pellets, detergent, cat litter, deicing salt or also powdered or granular construction materials. The carry handle on the side gusset makes the side-gusset bag easy to transport even with a heavy weight.

A side-gusset bag with the features described at the outset is also known from EP 2,039,620. The carry handle assembly is formed by a strip-shaped handle loop on one of the side gussets, extending transversely to the longitudinal direction of the respective side gusset and overlapping it with its ends. The transversely extending handle loop extends through holes on the face panels in the side-gusset bag and attached to the inner surface of the respective side gusset. A comfortable handling of the side-gusset bag is possible by means of the handle loop. However, with increasing package weight there is a danger that the handle loop will cut into the carrier's hand to a certain extent, which is felt to be unpleasant with very heavy bags. The introduction of force into the bag also requires improvement in the case of heavy loads. A pour hole can be formed on the side gusset opposite the handle loop, so that then the side-gusset bag can be held by the handle loop for emptying. To control the pouring operation, the bag is lifted by the other hand.

Side-gusset bags with the features mentioned above are known from EP 1,777,167 and EP 1,792,722 [US 2008/0080794] and have a single longitudinally extending carry handle running on one side edge and to start with lying flat against the side gusset. This results in the advantage that the carry handle is integrated into the side gusset in a protected manner. However, it can be difficult for the user to grasp the handle loop, and an arching of the handle loop also leads to a corresponding deformation of the side-gusset bag. In particular with very large loads, the handling and the load distribution need further improvement.

A side-gusset bag is known from EP 1 712 482 [U.S. Pat. No. 7,866,885] that has respective handle loops attached to the face panels. Since the outer surface of the face panels is not heat-sealable and furthermore uniform force distribution is desirable, punchouts provided at the ends of the handle loops are covered on the inside of the bag by respective heat-sealable film patches. The ends of the handle loops are directly welded to these film patches. In contrast to the embodiments previously described with a carry handle on one of the side gussets, the side-gusset bag described in EP 1,712,482 B1 is handled like a conventional open carrying bag in that the handle loops cannot be used for easy emptying of the contained goods.

Objects of the Invention

It is therefore an object of the present invention to provide an improved side-gusset bag.

Another object is the provision of such an improved is side-gusset bag that overcomes the above-given disadvantages, in particular that makes possible a particularly comfortable handling while in particular also being suitable for holding a large weight.

A further object is to provide an improved method making such a bag.

SUMMARY OF THE INVENTION

A side-gusset bag has according to the invention a pair of face panels each having a pair of side edges. Two respective side gussets are each connected between a respective one of the side edges of one of the face panels and a respective one of the side edges of the other face panel. The face panels and side gussets together form a bag body formed along each of the side edges flanking one of the gussets with at least one slot. Two respective carry handles each have a middle section outside the body and a pair of ends extending through the slot of a respective one of the side edges into the body with the two carry handles at least generally aligned with each other. Welds secure each of the ends inside the body to the respective side gusset and to the face panel forming therewith the respective side edge, and the same or different welds close the slots around the ends.

The provision of two parallel handle loops on the side gusset ensures uniform force distribution and an improved introduction of force into the body so that, on the one hand, the two handle loops cut into the hand of a carrier less and, on the other hand, the danger of the ends of the handle loops tearing out is reduced even with very large loads. According to the invention, the bag is held at four points spaced apart from one another so that the side-gusset bag is deformed less while being carried. Since the handle loops project from the body, they are easily seen and gripped by a user.

According to the invention, the two handle loops extend parallel to one another longitudinally. Regardless of the precise orientation of the handle loops, they are thus each fitted to the body at two points spaced longitudinally on the respective side edge and attached there to the inner surface of the body, usually one of the face panels and the respective side gusset. The handle loops can have, for example, a middle section running essentially longitudinally and from which the folded over ends project, preferably folded over approximately at right angles. However, an arcuate shape of the handle loops between the two ends spaced apart longitudinally is also conceivable. Because the handle loops run longitudinally, in addition to the improved force distribution, the possibility of raising or lowering the top of the bag by tilting the handle loops is produced, so that measuring out while pouring the bulk goods is facilitated.

Since the ends of the handle loops are fitted into the body, the external appearance of the side-gusset bag is not impaired. In particular with conventional bags a multilayered film is used so the outer surface of the body is not heat-sealable or can be heat sealed only with difficulty. A multilayered bag film of this type preferably has a heat-sealable layer of polyolefin on its inner surface. For example, laminated or coextruded films with an outer surface of polyethylene terephthalate (PET) and an inner surface of polyethylene (PE) are suitable. Without restriction further film layers, for example, to increase the stability and/or the barrier effect can be arranged between the inner layer and the outer layer. In the case of a laminated film, in particular also a metallic layer or a metallized plastic layer, for example, metallized polyethylene terephthalate laminated in between. Composite materials with an outer layer of oriented polypropylene (O-PP) or with layers of different polyethylene types can also be used within the scope of the invention, in the latter case the polymer composition being advantageously selected such that only the inner surface melts at a suitable sealing temperature. In addition to coextruded or PE films laminated in a multilayered manner, in principle heat-sealable monofilms, in particular PE monofilms, can also be used. Bag films that are formed completely of polyolefins are characterized in particular by a good recycling property. While laminated films can have an interior imprint produced by the lamination, coextruded films and monofilms are provided with an imprint on the outside, which can be covered by a protective lacquer to increase wear resistance.

The layer thicknesses of the heat-sealable layer of polyolefin are typically between 50 and 150 μm. Depending on the material, a much thinner layer is sufficient for the film layer that forms the outer surface of the body. Usually the thickness of this film layer is between 10 and 100 μm, in the case of materials such as polyethylene terephthalate and oriented polypropylene, particularly preferably between 10 and 30 μm.

In order to be able to make the side-gusset bag according to the invention, the ends of the handle loops must be fitted into the body. Preferably, the side edges to which the handle loops are attached are fold edges, and the ends of the handle loops are fitted into the body through slits. The slits can be made in the form of cuts or punchouts. Furthermore, after the formation of the fold edges to produce the slit it is possible to remove an outer edge of the fold edges at least in some sections. In the finished side-gusset bag, the slits are usually closed by weld seams, which also attach the handle loops to the inside of the bag. A separate slit can be provided for each end of the handle loops, the length of which slit is then preferably somewhat larger than the width of the handle loop. However, a single slit for each of the handle loops is also possible, and then the region between the longitudinally spaced ends of the two handle loops is closed by a longitudinal weld seam. Advantageously, the side edges are provided with longitudinal weld seams that extend over the entire length of the side gussets. Longitudinal weld seams of this type are then also used, independently of the bonding of the handle loops to one of the side gussets, to give the body a stable structure.

At the ends of the handle loops, the weld seams or sections of a full-length weld seam provided there serve to guarantee a uniform force distribution and a tight closure of the closed side-gusset bag and to prevent the handle loops from tearing even under heavy loads. In order to be able to meet increased mechanical demands, the longitudinal weld seams at the ends of the handle loops are offset away from the respective side edge and/or a have a greater width to produce a connection of larger surface area.

The handle loops should be heat-sealable on their two surfaces in order to be able to be securely welded to the respective one of the face panels and the respective side gusset. The handle loops in addition must have a high load-carrying capacity, to which end a sufficient material strength is needed. In particular, the handle loops can also be folded onto themselves as a flattened tube and be fixed by heat sealing. In addition to single-layer or multilayer films of polyethylene with a typical thickness between 100 and 400 μm, there is also the possibility of providing stiffer intermediate layers with an increased load-carrying capacity, for example, polyamide or polyethylene terephthalate. In a three-layer embodiment with outer layers of polyethylene and an intermediate layer of polyamide or polyethylene terephthalate, the total thickness is typically between 100 and 200 μm.

In order to be able to easily handle and set up the side-gusset bag, a stand-up bottom is preferably formed on a transverse side.

In the filled state the side-gusset bag is usually closed in an airtight manner and can then be opened at the top to remove the bulk goods. If the removal of only a partial amount is to be possible, a reclosable fastener can be provided for this purpose. It preferably has profile strips that can be locked to one another, and can be separated and connected either by direct application of force or by a slider. The reclosable fastener can be mounted on an upper bag edge and/or on the side gusset lying opposite the handle assembly. With the assembly of a reclosable fastener on the side gusset lying opposite the carry handle assembly, there is also the possibility of folding out this side gusset like a chute in the opened state of the reclosable fastener. Regardless of the exact embodiment of the reclosable fastener, the carry handle assembly according to the invention with two parallel handle loops running longitudinally facilitates a precise metering out of the bulk goods upon removal thereof.

The body is usually formed by folding and heat sealing the bag film.

The subject matter of the invention is also a method of making a side-gusset bag, in particular the previously described side-gusset bag, wherein a bag film is supplied, at least two slits running parallel to one another in a first direction are formed in sections of the bag film, film two handle loops are supplied to each section of the bag and inserted with their ends into the slits such that the handle loops extend with at least a middle section parallel to one another in the first direction, a film tube with face panels running along the first direction and side gussets between them are formed from the bag film by folding and heat-sealing, the ends of the handle loops are attached by heat-sealing to an inner face of the bag film of the film tube, after the formation of the film tube, longitudinal weld seams are formed on the side edges between the face panels and the side gussets provided with the handle loops such that longitudinal weld seams also fix the ends of the handle loops. There are different possibilities for the further embodiment of the method as well as the sequence of the individual steps.

According to a first embodiment, the slits are made in the bag film lying flat in the form of cuts or punchouts before forming the film tube. Subsequently, the handle loops are fitted to the bag film still lying flat, the ends of the handle loops being inserted into the cuts or punchouts and at least prefixed. The bag film is usually moved along the first direction cyclically, the handle loops with their ends then being inserted by a suitable gripper or the like transversely into the cuts or punchouts. In order to be able to thread in the ends, they are set slightly slanting on the bag film and/or to slightly lift the bag film lying flat per se with a gripper or a suction device on one side of the cuts or punchouts.

After the assembly of the handle loops on the bag film lying flat, a film tube is formed such that side edges are produced on the slits in the form of cuts or punchouts, on which side edges respectively one of the handle loops is arranged. Suitable guides for the handle loops are to be provided in order to handle the transversely projecting handle loops in a controlled manner during folding of the tube.

After making the film tube, longitudinal weld seams are usually formed on the side edges to give the side-gusset bag increased stability. In addition, the ends of the handle loop are to be attached to the body with sufficient strength and in an airtight manner. In order to achieve this, heat sealing can be done with different tools that cover different regions of a side edge.

Finally, individual bag blanks are cut from the film tube provided with the handle loops, which bag blanks are usually not closed on one of their two transverse ends for filling.

According to an alternative embodiment of the invention, first the film tube is formed from the bag film and subsequently the handle loops are supplied and attached. The handle loops are then inserted into slits that have preferably been made only after forming the film tube. For example, to this end an outer edge can be removed at least in part from the already formed film tube to produce a slit on two of the side edges. According to a preferred embodiment, partial weld seams with at least one break are formed that extend in the first direction over part of the length of the respective side edge, so that after the outer edge has been cut off over the entire length of the side edge on the breaks form slits into which subsequently both ends the handle loops can be inserted. If an outer edge is cut off on the side edges with the handle loops, the corresponding longitudinal weld seams can be made thicker there, so that they have sufficient thickness even after removal of the outer edge. In particular it is advantageous if both side gussets have the same width in the finished side-gusset bag. The side gusset from which the outer edges on the side edges are cut off is initially formed with a correspondingly greater width.

Multiple heat seals can also be made with the assembly of the handle loops after the formation of the film tube in order to ensure a functionally secure attachment of the handle loops. In particular different heat-sealing tools can be used to this end.

BRIEF DESCRIPTION OF THE DRAWING

The above and other objects, features, and advantages will become more readily apparent from the following description, reference being made to the accompanying drawing in which:

FIGS. 2A-2*e* show a method of making the side-gusset bag, and

SPECIFIC DESCRIPTION

Figure 1:
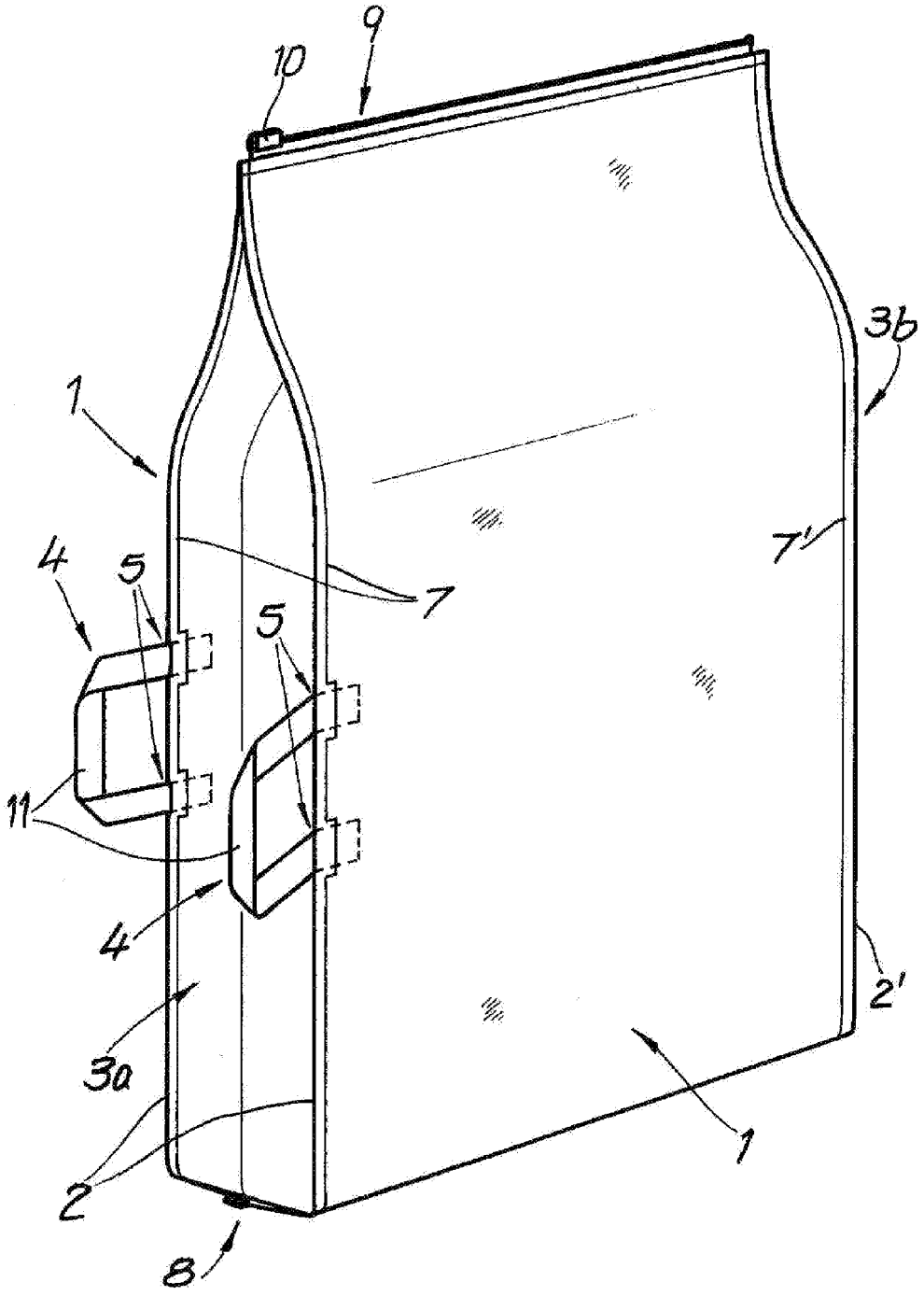
FIG. 1 is a perspective view of a side-gusset bag according to the invention.

As seen in FIG. 1, a side-gusset bag has a body comprised of two rectangular face panels 1 as well as side gussets 3*a* and 3*b* bridging and extending between longitudinally extending side edges 2 and 2' of the face panels 1. One of the side gussets 3*a* and 3*b* carries at approximately half the height of the bag a carry handle assembly formed by two handle loops 4 running parallel to one another longitudinally of the respective side gusset 3*a* and projecting from the body. The handle loops 4 are aligned perpendicular to the planes of the panels 1 so that they can be gripped in one hand.

The handle loops 4 have ends 5 that project at the side edges 2 into the bag body, which is formed from a multilayered bag film by folding and heat-sealing. To this end the body has slits 6 that are closed by heat-sealing. Longitudinal weld seams 7 and 7' are provided on all of the side edges 2 and 2' to stiffen and strengthen the side-gusset bag. On the side edges 2 provided with the handle loops 4, the longitudinal weld seams 7 also serve to close the slits 6 as well as to attach the ends 5 of the handle loops 4 to the inner face of the body, the ends 5 being attached to one of the face panels 1 as well as to the respective side gusset 3*a*. In order to make these longitudinal weld seams 7, different heat-sealing tools are used that cover different regions of the respective side edge 2. It can thus be advantageous to first form a weld in the region of the handle loops 4 before carrying out a full-length sealing to form the complete longitudinal weld seam 7.

FIG. 1 furthermore shows that the appearance of the side-gusset bag is not impaired by the assembly of the handle loops 4 and the production of heat-weld seams. The bag film that forms the face panels 1 and the side gussets 3*a* and 3*b* has an outer layer that is not heat-sealable or can be heat-sealed only with difficulty, being made of polyethylene terephthalate (PET) or oriented polypropylene (O-PP), for example. Accordingly, only the inner surface of the body, which is preferably made of a polyolefin such as polyethylene, is melted by the welding tool. However, the handle loops 4 must be heat-sealable on their two outer surfaces and typically have a thickness between 100 μm and 400 μm.

The side-gusset bag has a stand-up bottom 8 formed by folding on its lower transversely extending side. A reclosable fastener 9 provided on the opposite upper edge has profile strips that can be locked to one another. In the illustrated embodiment the reclosable fastener 9 shown by way of example is operated by a slider 10.

The handle loops 4 projecting transversely from the body can be gripped easily, held by essentially straight middle sections 11 running along the side gusset 3*a*. The ends 5 of the handle loops 4 are folded over at right angles to the respective middle sections 11.

FIGS. 2A through 2E show a first embodiment of a method of making the side-gusset bag. According to FIG. 2A, first of all a bag film is fed as a material web 12 lying flat, and two pairs of slits 6 running parallel to one another in the feed direction are punched out of the material web 12 while it is lying flat. These slits are produced where the side edges 2 will later run in the bag between the face panels 1 and the side gusset 3*a*. The punchouts are offset from the respective side edge 2 toward the side gusset 3*a* so that the face panels 1 are completely intact in the finished bag.

According to FIG. 2B, the ends 5 of the handle loops 4 are inserted into the slits, these ends extending from a middle section 11 of the handle loops 4 at a right angle.

Figure 2C:
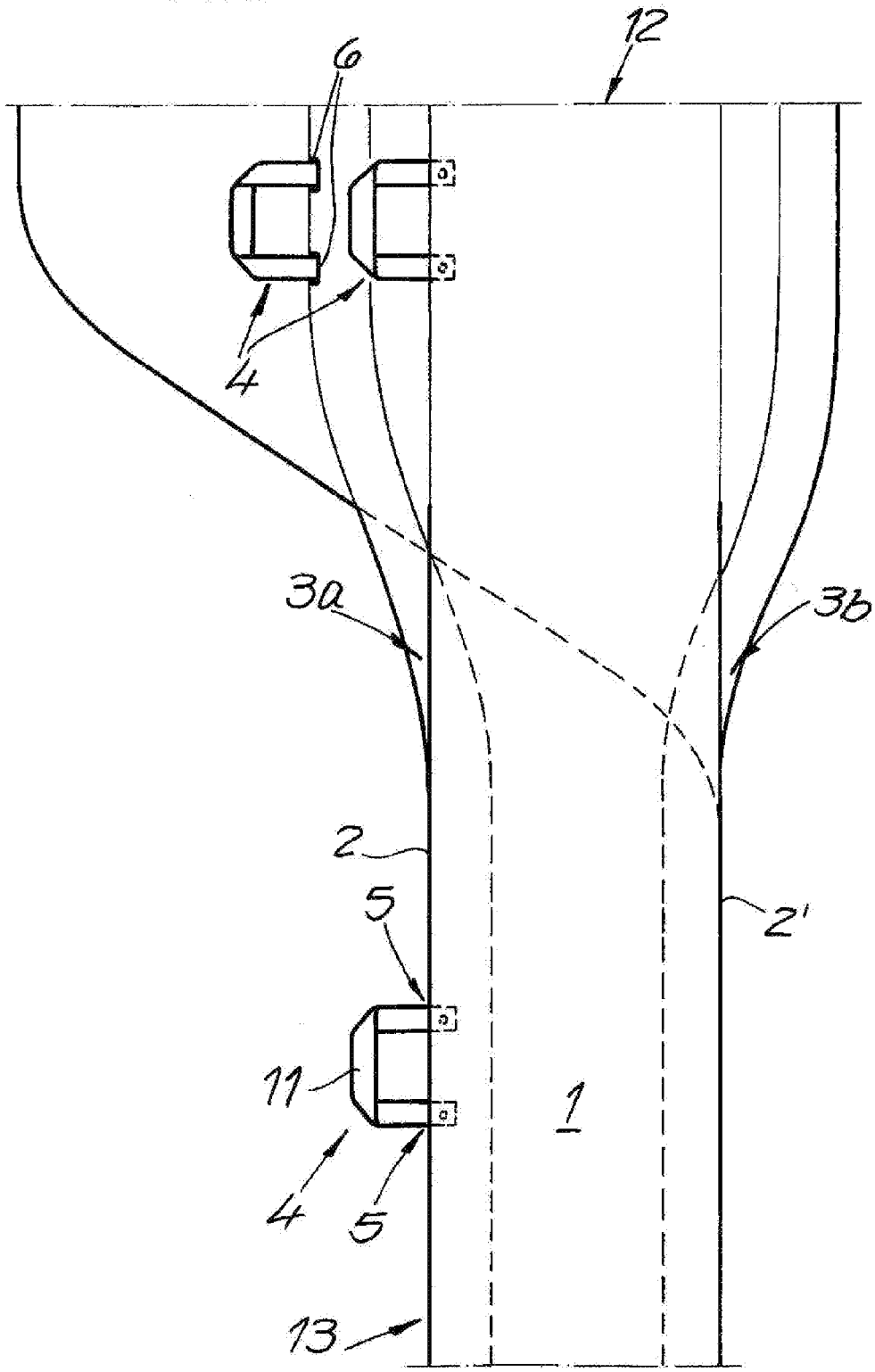

In order that the handle loops 4 remain in this position, the ends 5 are prefixed on the lower face of the material web 12 by heat sealing, and then a film tube 13 is subsequently formed by folding and heat-sealing the material web 12. The handle loops 4 must be guided such that they do not to and thus obstruct transport of the material web 12 (FIG. 2C).

Subsequently, the ends 5 of the handle loops 4 are welded at the side edges 2 provided with the handle loops 4 (FIG. 2D).

Subsequently, the full-length longitudinal weld seam 7 is formed by welding along the entire side edge 2 (FIG. 2E). Thereafter, individual bag blanks are cut from the film tube 13, each having a handle assembly with two parallel loop handles 4. The optionally installation of a reclosable fastener 9 is not shown in the figures.

Figure 3A:
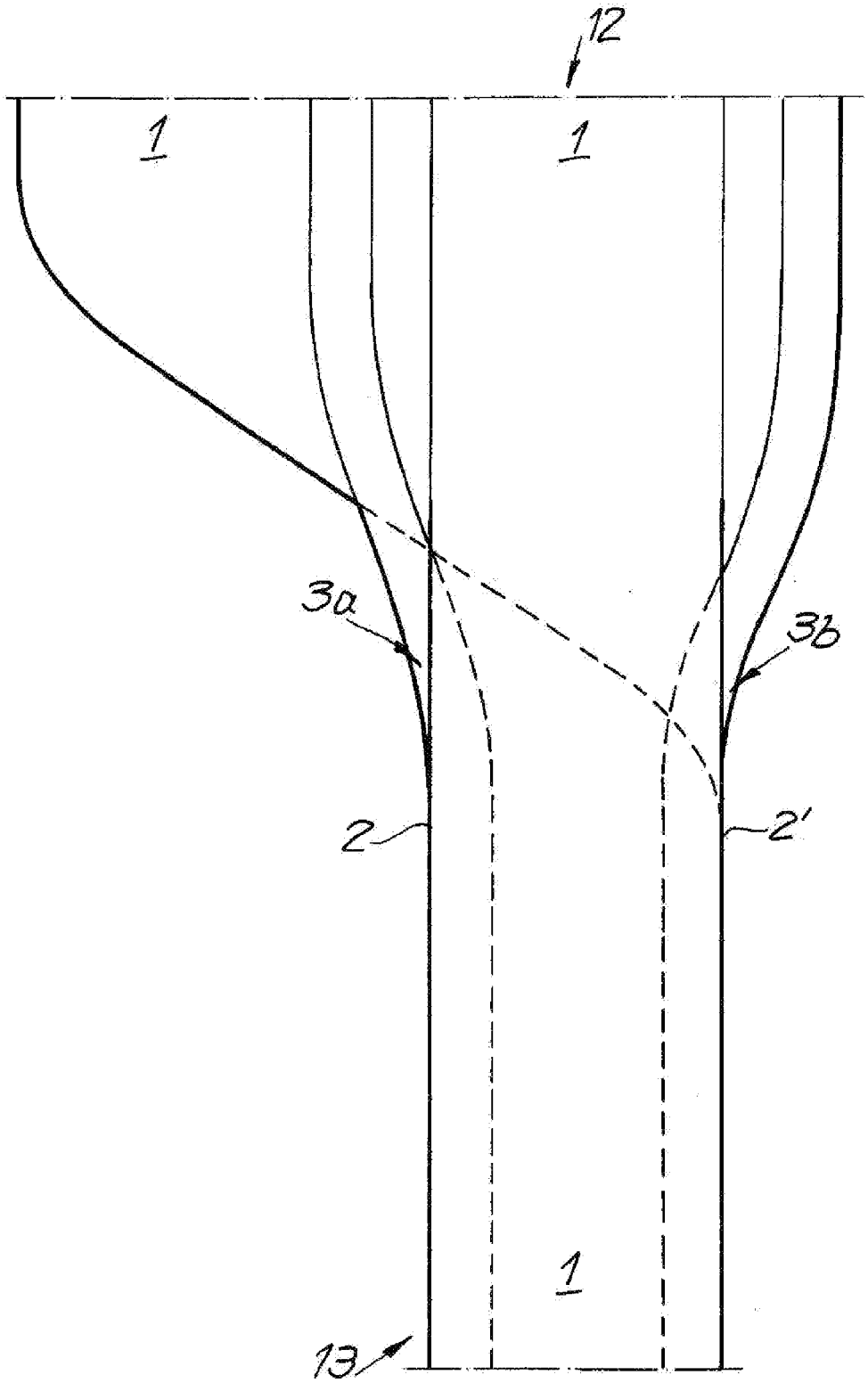
FIGS. 3A-3F show an alternative embodiment of the method.
Figure 3B:
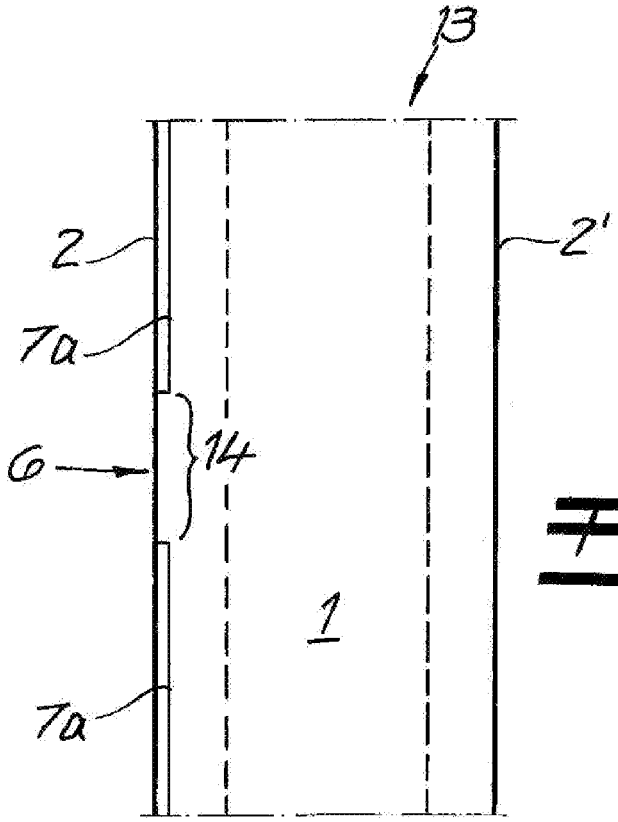
Figure 3C:
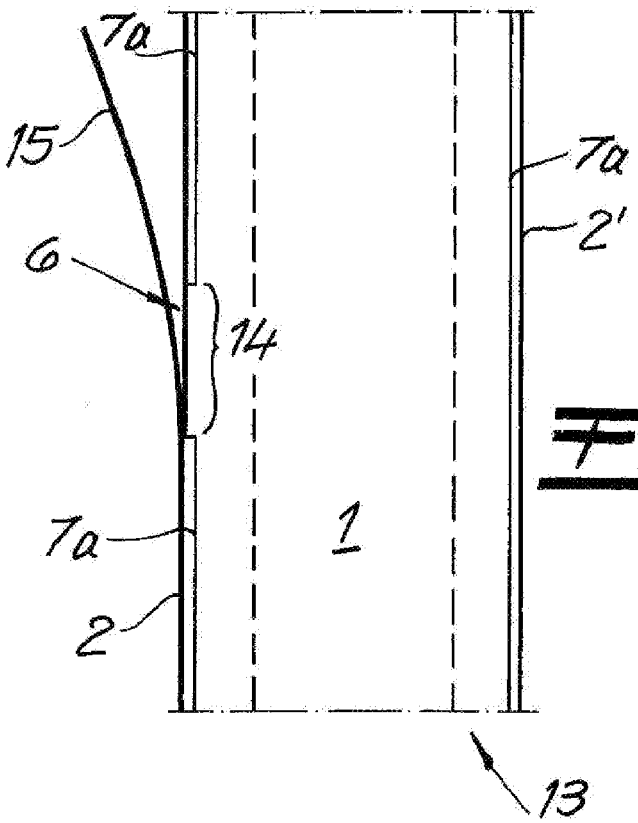
Figure 3D:
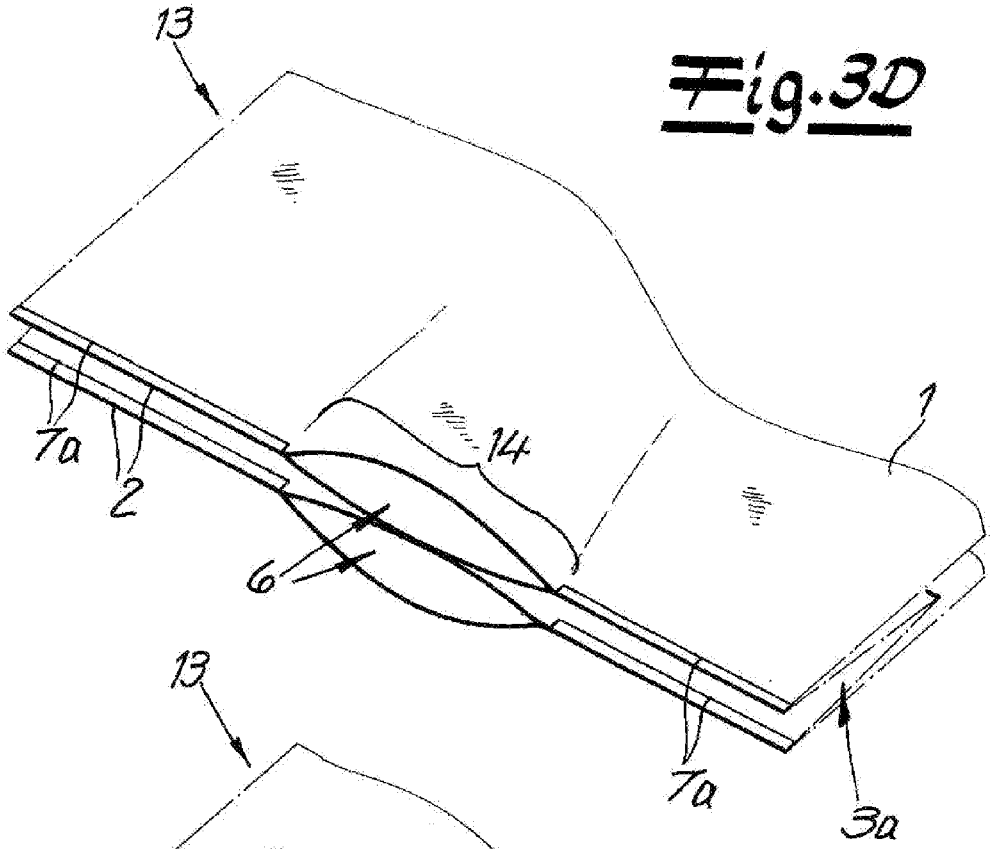

FIGS. 3A through 3F show a variant of the method in which first a film tube 13 is formed from the supplied material web 12. Then partial weld seams 7*a* are formed on the side edges 2 on which handle loops 4 are to be arranged, which partial weld seams are interrupted at breaks 14 (FIG. 3B). Subsequently, an outermost edge 15 of the corresponding side edges 2 is cut off (FIG. 3C), so that the previously formed partial weld seams 7*a* become slightly narrower. However, the breaks 14 form slits 6 that according to FIG. 3D can be spread by gripper fingers, a suction tool or the like, in order then to be able to insert the handle loops 4.

Figure 3E:
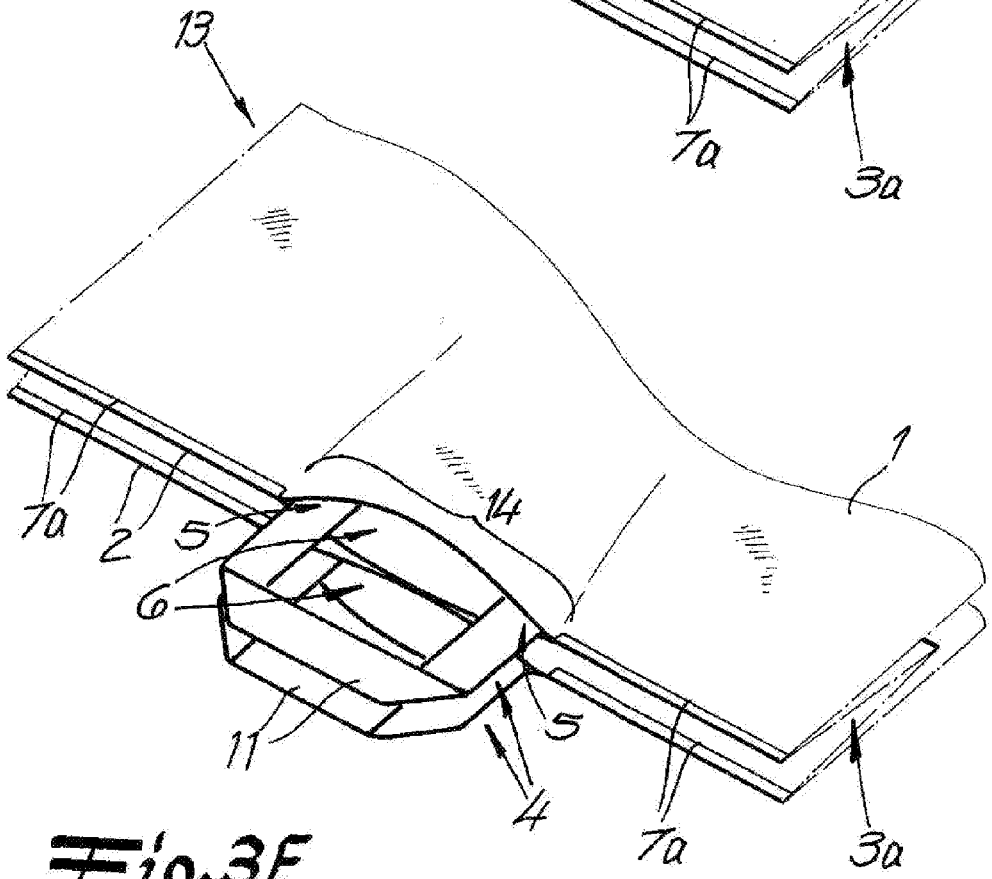

FIG. 3E shows that according to the illustrated embodiment both ends 5 of each handle loop 4 are inserted into an respective slit 6, to which end each slit 6 is somewhat longer than the longitudinal dimension of the respective handle loop 4.

Figure 3F:
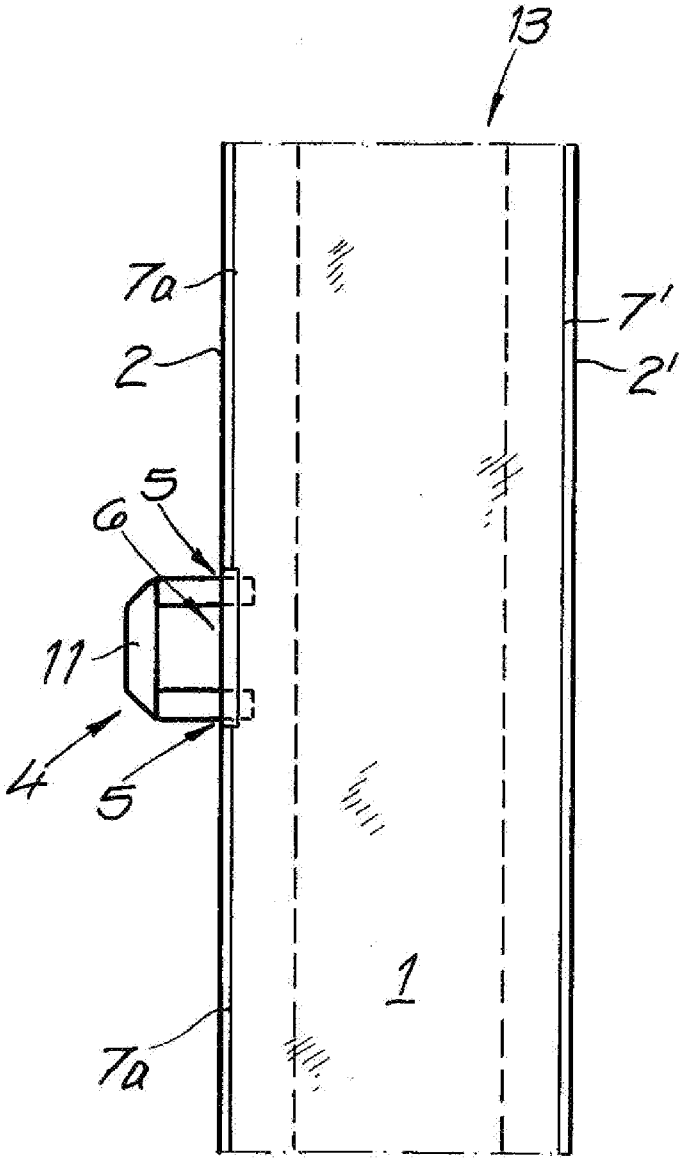

As indicated in FIG. 3F, the slits 6 then are closed by longitudinal weld seams such that the ends 5 of the handle loops 4 are fixed in place. In order to achieve a tight closure, a multiple heat-sealing can be carried out. In particular, the regions directly at the ends 5 of the handle loop 4 on the one hand and the region running between them on the other hand can be welded separately from one another with different tools

We claim:

1. A method of making a side-gusset bag, the method comprising the steps of:

forming in a longitudinally extending bag film at least two longitudinally extending and transversely spaced slits;

supplying two handles having middle sections and two ends and inserting the ends of each of the handles transversely into a respective one of the slits such that the middle sections of the tubes extend longitudinally;

forming and heat sealing the film into a tube with two superposed and longitudinally extending face panels and two gussets folded transversely between and joined to longitudinally extending side edges of the face panels, with the slits lying generally at the side edges flanking one of the side gussets and the middle sections of the handles lying generally atop one another outside the tube;

attaching the ends of the handles to an inner face of the bag film; and longitudinally welding along each of the side edges to seal the slits around the handle ends.

2. The method defined in claim 1 wherein the slits are formed by cutting or punching in the bag film before forming the film into the tube.

3. The method defined in claim 1 wherein the handles are attached to the inner face of the film before formation of the web into the tube.

4. The method defined in claim 1 wherein the handles are supplied and inserted after the film is formed into the tube.

5. The method defined in claim 1 wherein each of the side edges is welded multiple times.

6. The method defined in claim 5 wherein each of the multiple welds of the side edges is carried out with a different tool.

7. The method defined in claim 1 wherein the web is formed at each of a plurality of longitudinally succeeding sections with at least two such transversely spaced slots and is subsequently folded and heat sealed into a tube forming two respective face panels and two side gussets in each of the sections.

8. A method of making a side-gusset bag, the method comprising the steps of sequentially:

forming and heat sealing a longitudinally extending bag film web into a tube with two superposed and longitudinally extending face panels and two gussets folded transversely between and joined to longitudinally extending side edges of the face panels;

forming a discontinuous longitudinal weld having a break along each of the side edges flanking the one gusset;

cutting fold portions off the side edges flanking the one side gusset at the breaks and thereby forming at the side edges of the one gusset two longitudinally spaced pairs of longitudinally extending and transversely spaced slits;

supplying two handle loops each having a middle sections and two ends and inserting the ends of each of the handle loops into a respective one of the slits such that the middle sections of the handle loops lie generally atop one another outside the tube;

attaching the ends of the handle loops to an inner face of the bag film; and longitudinally welding along each of the side edges at the one gusset to seal the slits around the handle ends.

* * * * *